US008983830B2

(12) United States Patent
Zhou et al.

(10) Patent No.: US 8,983,830 B2
(45) Date of Patent: Mar. 17, 2015

(54) STEREO SIGNAL ENCODING DEVICE INCLUDING SETTING OF THRESHOLD FREQUENCIES AND STEREO SIGNAL ENCODING METHOD INCLUDING SETTING OF THRESHOLD FREQUENCIES

(75) Inventors: Jiong Zhou, Singapore (SG); Kok Seng Chong, Singapore (SG); Koji Yoshida, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 940 days.

(21) Appl. No.: 12/593,033

(22) PCT Filed: Mar. 28, 2008

(86) PCT No.: PCT/JP2008/000808
§ 371 (c)(1),
(2), (4) Date: Sep. 25, 2009

(87) PCT Pub. No.: WO2008/126382
PCT Pub. Date: Oct. 23, 2008

(65) Prior Publication Data

US 2010/0106493 A1 Apr. 29, 2010

(30) Foreign Application Priority Data

Mar. 30, 2007 (JP) ..... 2007-092751

(51) Int. Cl.
*G10L 19/00* (2013.01)
*G10L 19/06* (2013.01)
(Continued)

(52) U.S. Cl.
CPC ..... *G10L 19/24* (2013.01); *G10L 19/00* (2013.01); *G10L 19/06* (2013.01); *G10L 19/008* (2013.01)
USPC ..... 704/216; 704/219

(58) Field of Classification Search
USPC ..... 704/200–218, 219, 220–225, 500–504, 704/E19.001–E19.049, E21.001–E21.02, 704/E11.001–E11.007; 281/1–28; 381/1–28
See application file for complete search history.

(56) References Cited

U.S. PATENT DOCUMENTS 4,677,671 A * 6/1987 Galand et al. ..... 704/212
5,172,415 A * 12/1992 Fosgate ..... 381/22
(Continued)

FOREIGN PATENT DOCUMENTS

JP 7-23009 1/1995
JP 7-87033 3/1995
(Continued)

OTHER PUBLICATIONS

Koji Yoshida et al., "A Preliminary Study of Inter-Channel Prediction for Scalable Stereo Speech Coding", p. 118, along with an English language translation, Institute of Electronics, Information and Communication Engineers, Mar. 7, 2005.
(Continued)

*Primary Examiner* — Edgar Guerra-Erazo
*Assistant Examiner* — David Kovacek
(74) *Attorney, Agent, or Firm* — Greenblum & Bernstein, P.L.C.

(57) ABSTRACT

An encoding device can achieve both highly effective encoding/decoding and high-quality decoding audio when executing a scalable stereo audio encoding by using MDCT and ICP. In the encoding device, an MDCT converter executes an MDCT conversion on a residual signal of left channel/right channel subjected to window processing. An MDCT converter executes an MDCT conversion on the monaural residual signal which has been subjected to the window processing. An ICP analyzer executes an ICP analysis by using the correlation between a frequency coefficient of a high-band portion of the left channel/right channel and a frequency coefficient of a high-band portion of the monaural residual signal so as to generate an ICP parameter of the left channel/right channel residual signal. An ICP parameter quantizes each of the ICP parameters. A low-band encoding unit encoder executes highly-accurate encoding on the frequency coefficient of the low-band portion of the left channel/right channel residual signal.

2 Claims, 4 Drawing Sheets

(51) Int. Cl.
*G10L 19/24* (2013.01)
*G10L 19/008* (2013.01)

(56) References Cited

U.S. PATENT DOCUMENTS

| | | | | |
|---|---|---|---|---|
| 5,859,826 | A | 1/1999 | Ueno et al. | |
| 5,890,108 | A * | 3/1999 | Yeldener | 704/208 |
| 6,041,295 | A * | 3/2000 | Hinderks | 704/206 |
| 6,311,153 | B1 * | 10/2001 | Nakatoh et al. | 704/216 |
| 6,393,392 | B1 | 5/2002 | Minde | |
| 6,424,939 | B1 * | 7/2002 | Herre et al. | 704/219 |
| 6,446,037 | B1 * | 9/2002 | Fielder et al. | 704/229 |
| 6,526,376 | B1 * | 2/2003 | Villette et al. | 704/207 |
| 6,606,600 | B1 * | 8/2003 | Murgia et al. | 704/500 |
| 6,680,972 | B1 * | 1/2004 | Liljeryd et al. | 375/240 |
| 7,191,136 | B2 * | 3/2007 | Sinha et al. | 704/500 |
| 2003/0101048 | A1 * | 5/2003 | Liu | 704/208 |
| 2004/0064311 | A1 * | 4/2004 | Sinha et al. | 704/219 |
| 2005/0141721 | A1 * | 6/2005 | Aarts et al. | 381/16 |
| 2005/0149322 | A1 * | 7/2005 | Bruhn et al. | 704/211 |
| 2005/0159942 | A1 * | 7/2005 | Singhal | 704/219 |
| 2006/0085200 | A1 * | 4/2006 | Allamanche et al. | 704/500 |
| 2006/0136229 | A1 * | 6/2006 | Kjoerling et al. | 704/501 |
| 2006/0195314 | A1 * | 8/2006 | Taleb et al. | 704/200.1 |
| 2006/0246868 | A1 | 11/2006 | Taleb et al. | |
| 2007/0019813 | A1 * | 1/2007 | Hilpert et al. | 381/22 |
| 2007/0033056 | A1 * | 2/2007 | Herre et al. | 704/503 |
| 2007/0094037 | A1 * | 4/2007 | Pang et al. | 704/503 |
| 2008/0262850 | A1 * | 10/2008 | Taleb et al. | 704/500 |
| 2009/0012796 | A1 * | 1/2009 | Jung et al. | 704/500 |
| 2009/0055169 | A1 | 2/2009 | Goto et al. | |
| 2009/0055172 | A1 | 2/2009 | Yoshida | |
| 2009/0070107 | A1 | 3/2009 | Kawashima et al. | |
| 2009/0076809 | A1 | 3/2009 | Yoshida | |
| 2009/0083041 | A1 | 3/2009 | Yoshida | |
| 2009/0119111 | A1 * | 5/2009 | Goto et al. | 704/500 |
| 2010/0106493 | A1 * | 4/2010 | Zhou et al. | 704/219 |

FOREIGN PATENT DOCUMENTS

| | | |
|---|---|---|
| JP | 8-65169 | 3/1996 |
| JP | 10-51313 | 2/1998 |
| JP | 2002-52798 | 8/2002 |
| JP | 2002-526798 | 8/2002 |
| WO | 00/19413 | 4/2000 |

OTHER PUBLICATIONS

English language Abstract of JP 2002-526798, Aug. 20, 2002.
Samsudin et al., "A Stereo to Mono Dowmixing Scheme for MPEG-4 Parametric Stereo Encoder", Acoustics, Speech and Signal Processing, 2006, ICASSP 2006 Proceedings, 2006 IEEE International Conference in Toulouse, France May 14-19, 2006, Piscataway, NJ, USA, IEEE, Piscataway, NJ, USA, LNKD-DOI:10.1109/ICASSP.2006.1661329 , May 14, 2006, pp. V, 529-530, XP031387161, ISBN: 978-1-4244-0469-8-.
Supplementary European Search Report from European Patent Office dated Nov. 24, 2010.
English language Abstract of JP 7-87033, Mar. 31, 1995.
English language Abstract of JP 8-65169, Mar. 8, 1996.
English language Abstract of JP 10-51313, Feb. 20, 1998.
English language Abstract of JP 7-23009, Jan. 24, 1995.
English language Abstract of JP 2002-52798, Aug. 20, 2002.
3GPP TS 26.290. V6.3.0 (Jun. 2005), "Extended AM Wideband Speech Codec (AMR-WB+): Transcoding Functions", URL:http://www.3gpp.org/FTP/Specs/html/html-info/26290.htm, pp. 10-53.
Kamamoto et al., "Channel-kan Sokan o Mochiita Ta-Channel Shingo no kagyaku Assuku Fugoka", Transactions of Information Processing Society of Japan, May 15, 2005, vol. 46, No. 5, pp. 1118-1128.
Minami et al., "Stereophonic ADPCM voice coding method," in Proc. ICASSP'90, Apr. 1990.
Wang et al., "The modified discrete cosine transform: its implications for audio coding and error concealment," in AES 22$^{nd}$ International Conference on Virtual, Synthetic and Entertainment, 2002.
Ramprashad, "The multimode transform predictive coding paradigm," IEEE Tran. Speech and Audio Processing, vol. 11, pp. 117-129, Mar. 2003.

* cited by examiner

STEREO SIGNAL ENCODING DEVICE INCLUDING SETTING OF THRESHOLD FREQUENCIES AND STEREO SIGNAL ENCODING METHOD INCLUDING SETTING OF THRESHOLD FREQUENCIES

TECHNICAL FIELD

The present invention relates to a coding apparatus and coding method that are used to encode stereo speech signals and stereo audio signals in mobile communication systems or in packet communication systems using the Internet protocol ("IP").

BACKGROUND ART

In mobile communication systems or packet communication systems using IP, the restriction of the digital signal processing speed in DSP (Digital Signal Processor) and bandwidth are gradually relaxed. If the transmission rate becomes a higher bit rate, a band for just transmitting a plurality of channels can be acquired, so that communication using the stereo scheme (i.e. stereo communication) is expected to become popular even in speech communication where the monaural scheme is currently a mainstream.

Current mobile telephones have already mounted a multimedia player, which provides stereo function, and FM radio functions. Therefore, it naturally follows that the fourth generation mobile telephones and IP telephones have functions of recording and playing speech communication by stereo speech and stereo speech signals in addition to stereo audio signals.

One popular method of encoding a stereo speech signal adopts the signal prediction technique based on a monaural speech codec. That is, the fundamental channel signal is transmitted using a known monaural speech codec, to predict the left channel or right channel from this basic channel signal using additional information and parameters. In many applications, a mixed monaural signal is selected as the fundamental channel signal.

Until now, methods of encoding a stereo signal include ISC (Intensity Stereo Coding), BCC (Binaural Cue Coding), ICP (Inter-Channel Prediction), and so on. These parametric stereo coding methods have different strengths and weaknesses, making these methods suitable for coding of different excitations (source materials).

Non-Patent Document 1 discloses a technique of predicting a stereo signal based on a monaural codec, using those coding methods. To be more specific, a monaural signal is generated by synthesis using channel signals forming a stereo signal such as the left channel signal and the right channel signal, the resulting monaural signal is encoded/decoded using a known speech codec, and, furthermore, the difference signal (i.e. side signal) between the left channel and the right channel is predicted from the monaural signal using prediction parameters. In such a coding method, the coding side models the relationship between the monaural signal and the side signal using time-dependent adaptive filters, and transmits filter coefficients calculated on per frame basis, to the decoding side. The decoding side reconstructs the difference signal by filtering the monaural signal of high quality transmitted by the monaural codec, and calculates the left channel signal and the right channel signal from the reconstructed difference signal and the monaural signal.

Further, Non-Patent Document 2 discloses a coding method using a so-called "cross-channel correlation canceller," and, when the technique using a cross-channel correlation canceller is applied to the coding method of the ICP scheme, it is possible to predict one channel from the other channel.

Recently, audio compression technology has been rapidly developed, and, in particular, the modified discrete cosine transform ("MDCT") scheme is the predominant method in high quality audio coding (see Non-Patent Document 3 and Non-Patent Document 4).

In addition to the energy compaction capability, MDCT achieves critical sampling, reduced block effect and flexible window switching at the same time. MDCT uses the concept of time domain alias cancellation ("TADC") and frequency domain alias cancellation. Further, MDCT is designed to achieve perfect reconstruction.

MDCT is widely used in an audio coding paradigm. Further, in a case where a proper window (e.g. sine window) is employed, MDCT has been applied to audio compression without major perceptual problems. In recent years, MDCT plays an important role in the multimode transform predictive coding paradigm.

The multimode transform predictive coding paradigm combines a speech coding principle and audio coding principle in a single coding structure (see Non-Patent Document 4). Here, the MDCT-based coding structure and its application in Non-Patent Document 4 are designed for encoding signals of only one channel, using different quantization schemes to quantize MDCT coefficients in different frequency domains.

Non-Patent Document 1: Extended AMR Wideband Speech Codec (AMR-WB+): Transcoding functions, 3GPP TS 26.290.

Non-Patent Document 2: S. Minami and O. Okada, "Stereophonic ADPCM voice coding method," in Proc. ICASSP '90, April 1990.

Non-Patent Document 3: Ye Wang and Miikka Vilermo, "The modified discrete cosine transform: its implications for audio coding and error concealment," in AES 22nd International Conference on Virtual, Synthetic and Entertainment, 2002.

Non-Patent Document 4: Sean A. Ramprashad, "The multimode transform predictive coding paradigm," IEEE Tran. Speech and Audio Processing, vol. 11, pp. 117-129, March 2003.

DISCLOSURE OF INVENTION

Problems to be Solved by the Invention

For the coding schemes used in Non-Patent Document 2, when the correlation between two channels is high, the performance of ICP is sufficient. However, when the correlation is low, adaptive filter coefficients of higher order are needed, and sometimes the cost to increase the prediction gain is too high. If the filter order is not increased, the energy level of prediction error may be the same as that the energy level of a reference signal, and ICP is useless in such a situation.

The low frequency part in the frequency domain is essentially critical to the quality of a speech signal. That is, minor errors in the low frequency part of decoded speech will degrade the overall speech quality a lot. Because of the limitation of the prediction performance of ICP in speech coding, sufficient performance for the low frequency part is difficult to achieve when the correlation between two channels is not high, and it is therefore preferable to employ another coding scheme.

In Patent Document 1, ICP is applied only to the high frequency band signals in the time domain. This is one solution to the above problem. However, in Non-Patent Document 1, an input monaural signal is used for ICP prediction at an encoder. Preferably, a decoded monaural signal should be used. This is because, on the decoder side, a reconstructed stereo signal is acquired by an ICP synthesis filter, which uses a monaural signal decoded by the monaural decoder. However, if the monaural encoder is a type of transform coder such as a MDCT transform coder, which is used widely, especially for wideband (7 kHz or above) audio coding, some additional algorithmic delay is caused to acquire a time domain decoded monaural signal on the encoder side.

It is therefore an object of the present invention to provide a coding apparatus and coding method for realizing both improved efficiency of coding/decoding and improved quality of decoded speech when scalable stereo speech coding is performed using MDCT and ICP.

Means for Solving the Problem

The coding apparatus of the present invention employs a configuration having: a residual signal acquiring section that acquires a first channel residual signal and second channel residual signal that are linear prediction residual signals for a first channel signal and second channel signal of a stereo signal; a frequency domain transform section that transforms the first channel residual signal and the second channel residual signal into a frequency domain and acquires a first channel frequency coefficient and second channel frequency coefficient; a first encoding section that encodes the first channel frequency coefficient and the second channel frequency coefficient in a band lower than a threshold frequency, using a coding method of relatively high precision; and a second encoding section that encodes the first channel frequency coefficient and the second channel frequency coefficient in a band equal to or higher than the threshold frequency, using a coding method of relatively low precision.

The coding method of the present invention includes: a residual signal acquiring step of acquiring a first channel residual signal and second channel residual signal that are linear prediction residual signals for a first channel signal and second channel signal of a stereo signal; a frequency domain transform step of transforming the first channel residual signal and the second channel residual signal into a frequency domain and acquiring a first channel frequency coefficient and second channel frequency coefficient; a first encoding step of encoding the first channel frequency coefficient and the second channel frequency coefficient in a band lower than a threshold frequency, using a coding method of relatively high precision; and a second encoding step of encoding the first channel frequency coefficient and the second channel frequency coefficient in a band equal to or higher than the threshold frequency, using a coding method of relatively low precision.

Advantageous Effect of Invention

According to the present invention, by applying a coding method of high quantization precision to the lower band part of relatively high perceptual importance level and applying an efficient coding method with ICP to the higher band part of relatively low perceptual importance level, it is possible to realize both improved efficiency of coding/decoding and improved quality of decoded speech.

Further, by applying monaural signals decoded in the MDCT domain by a MDCT transform encoder to ICP process, ICP is directly performed in the MDCT domain, so that additional delay due to algorithms is not caused.

BEST MODE FOR CARRYING OUT THE INVENTION

Embodiment 1

Embodiment 1 of the present invention will be explained below with reference to the accompanying drawings. Here, in the following explanation, a left channel signal, right channel signal, monaural signal and their reconstructed signals are represented by L, R, M, L', R' and M', respectively. Further, in the following explanation, the length of each frame is N, and the MDCT domain signals for the monaural, left and right signals are represented by m(f), l(f) and r(f), respectively. Also, the correspondence relationship between the names of signals and their codes are not limited to the above.

Figure 1:
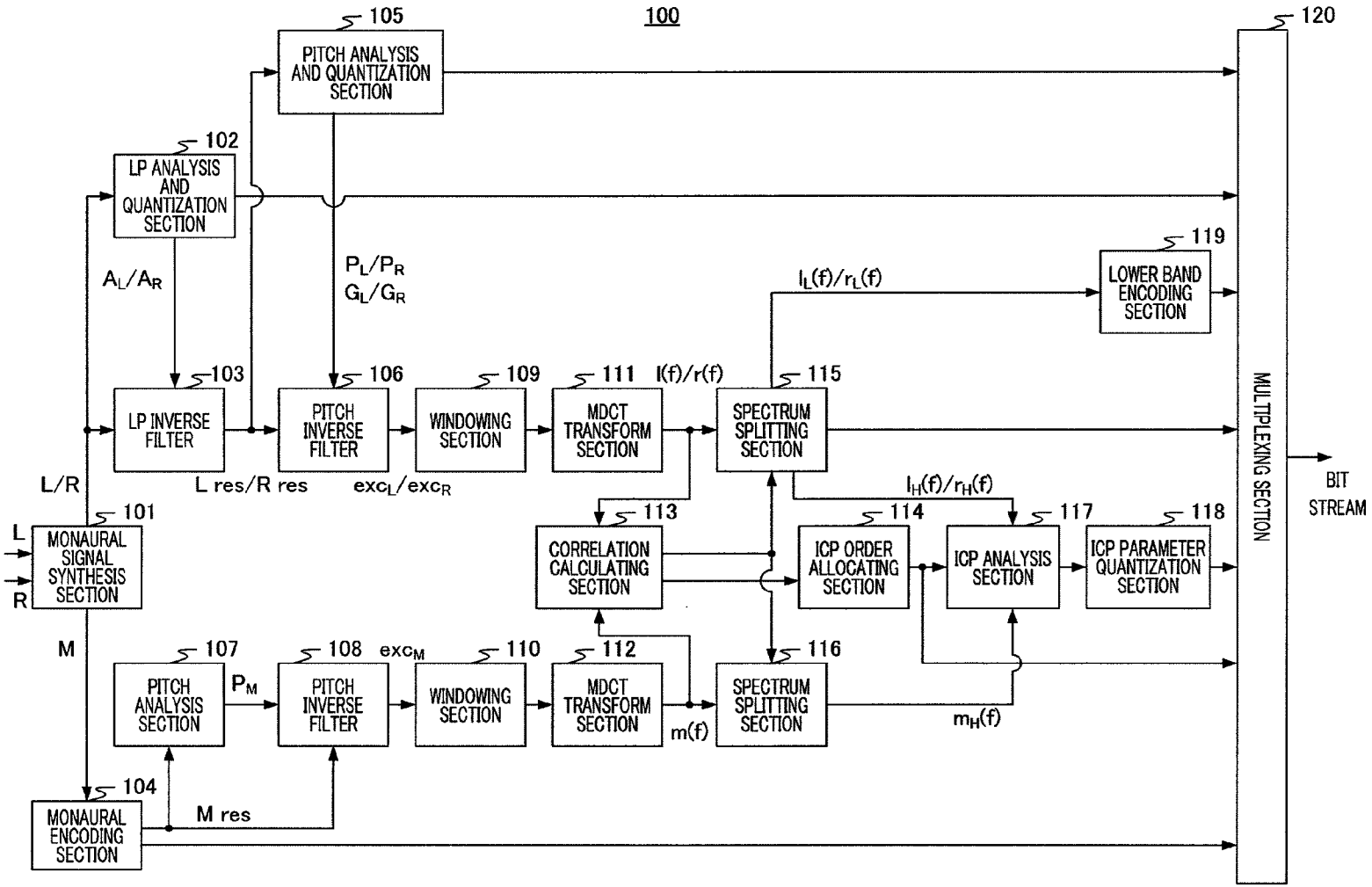
FIG. 1 is a block diagram showing the configuration of a coding apparatus according to Embodiment 1 of the present invention.

FIG. 1 is a block diagram showing the configuration of the coding apparatus according to the present embodiment. Coding apparatus 100 shown in FIG. 1 receives as input stereo signals comprised of the left and right channel signals of PCM (Pulse Code Modulation) format on a per frame basis.

Monaural signal synthesis section 101 synthesizes the left channel signal L and the right channel signal R according to following equation 1, and generates the monaural speech signal M. Monaural signal synthesis section 101 outputs the left channel signal L and the right channel signal R to LP (Linear Prediction) analysis and quantization section 102, and outputs the monaural speech signal M to monaural coding section 104.

(Equation 1)

$$M(n) = \frac{1}{2}[L(n) + R(n)] \quad [1]$$

In this equation 1, n represents a time index in a frame. Here, the mixing method to generate a monaural signal is not limited to equation 1. It is also possible to generate a monaural signal by means of other methods such as a method of adaptively weighting and mixing signals.

LP analysis and quantization section 102 finds LP parameters by LP analysis of the left channel signal L and right channel signal R and quantizes these LP parameters, outputs encoded data of the found LP parameters to multiplexing section 120 and outputs LP coefficients $A_L$ and $A_R$ to LP inverse filter 103.

LP inverse filter 103 performs LP inverse filtering of the left channel signal L and right channel signal R using LP coefficients $A_L$ and $A_R$, and outputs the resulting left and right channel residual signals Lres and Rres to pitch analysis and quantization section 105 and pitch inverse filter 106.

Monaural coding section 104 encodes the monaural signal M and outputs the resulting encoded data to multiplexing section 120. Further, monaural coding section 104 outputs the monaural residual signal Mres to pitch analysis section 107 and pitch inverse filter 108. Here, a residual signal is also referred to as an "excitation signal." This residual signal can be extracted from most monaural speech coding apparatuses (e.g. CELP-based coding apparatus) or the type of coding apparatuses that include the process of generating LP residual signals or locally decoded residual signals.

Pitch analysis and quantization section 105 performs a pitch analysis and quantization of the left and right channel residual signals Lres and Rres, outputs the pitch parameters of the resulting left and right channel residual signals (i.e. pitch periods $P_L$ and $P_R$ and pitch gains $G_L$ and $G_R$) to pitch inverse filter 106, and outputs encoded data of the pitch parameters to multiplexing section 120.

Pitch inverse filter 106 performs pitch inverse filtering of the left and right channel residual signals Lres and Rres using the pitch parameters, and outputs the left and right channel residual signals $exc_L$ and $exc_R$ not including the pitch period components.

Pitch analysis section 107 performs a pitch analysis of the monaural residual signal Mres and outputs the pitch period $P_M$ of the monaural residual signal to pitch inverse filter 108. Pitch inverse filter 108 performs pitch inverse filtering of the monaural residual signal Mres using the pitch period $P_M$, and outputs the monaural residual signal $exc_M$ not including the pitch period components to windowing section 110.

Windowing section 109 performs windowing processing of the left and right channel residual signals $exc_L$ and $exc_R$ and outputs the results to MDCT transform section 111. Windowing section 110 performs windowing processing of the monaural residual signal $exc_M$ and outputs the result to MDCT transform section 112. Sine window h(k) required for the windowing processing in windowing section 109 and windowing section 110 is widely used in the prior art and calculated according to following equation 2.

(Equation 2)

$$h(k) = \sin\left[\pi \frac{(k+0.5)}{2N}\right] \quad [2]$$
$$k = 0, \ldots 2N-1$$

MDCT transform section 111 performs a MDCT transform of the left and right channel residual signals $exc_L$ and $exc_R$ and outputs the frequency coefficients l(f) and r(f) of the resulting left and right channel residual signals to correlation calculating section 113 and spectrum splitting section 115. MDCT transform section 112 performs a MDCT transform of the monaural residual signal $exc_M$ subjected to windowing processing, and outputs the frequency coefficients m(f) of the resulting monaural residual signal to correlation calculating section 113 and spectrum splitting section 116. Also, frequency coefficients acquired by the MDCT transform are generally referred to as "MDCT coefficients."

The frequency coefficients l(f) of the left channel residual signal acquired by the MDCT transform in MDCT transform section 111 is calculated according to following equation 3. Here, in this equation 3, s(k) represents a windowed residual signal of a length of 2N. Also, the frequency coefficients r(f) of the right channel residual signal are calculated in the same way.

(Equation 3)

$$l(f) = \sum_{k=0}^{2N-1} s(k)\cos\left[\pi \frac{(k+N/2+0.5)(f+0.5)}{N}\right] \quad [3]$$
$$f = 0, \ldots N-1$$

Correlation calculating section 113 calculates the correlation value c1 between the frequency coefficients l(f) of the left channel residual signal and the frequency coefficients m(f) of the monaural residual signal, and the correlation value c2 between the frequency coefficients r(f) of the right channel residual signal and the frequency coefficients m(f) of the monaural residual signal, and outputs the absolute values of these correlation values to ICP order allocating section 114. Further, correlation calculating section 113 determines the split frequency FTH using the calculation results, according to following equation 4, and outputs information indicating the split frequency to spectrum splitting section 115 and spectrum splitting section 116. Here, according to equation 4, the split frequency FTH decreases when the correlation becomes higher. Further, in the following equation, the frequency band lower than the split frequency FTH is referred to as the "lower band part," and the frequency band equal to or higher than the split frequency FTH is referred to as the "higher band part."

(Equation 4)

$$F_{TH} = \left(1k + \frac{Fs}{32} \times \frac{c_2}{c_1 + c_2}\right) \quad [4]$$

In equation 4, Fs represents the sampling frequency. The sampling frequency can be 16 kHz, 24 kHz, 32 kHz or 48 kHz. Further, constants "1k" and "32" in equation 4 are examples, and the present embodiment can set these values arbitrarily.

Also, the split frequency FTH can be calculated based on the bit rate. For example, to perform coding at a predetermined bit rate, there is only a total of X MDCT coefficients that can be encoded in the lower band part of the frequency coefficients l(f) of the left channel residual signal and the frequency coefficients r(f) of the right channel residual signal. The channel of higher correlation with the monaural frequency coefficients m(f) requires fewer MDCT coefficients for coding. Correlation calculating section 113 calculates the number of frequency coefficients in the lower band part of the frequency coefficients l(f) of the left channel residual signal, according to X×c2/(c1+c2), and calculates the number of frequency coefficients in the lower band part of the frequency coefficients r(f) of the right channel residual signal, according to X×c1/(c1+c2).

The sum of the ICP orders of the left and right channels normally stays constant. ICP order allocating section 114 calculates the ICP order allocated to the left channel based on the correlation value, so as to decrease the ICP order when the correlation becomes higher. When the sum of ICP orders is ICPor, ICP order allocating section 114 calculates the ICP order of the left channel by ICPor×c2/(c1+c2). Also, it is possible to calculate the ICP order of the right channel by ICPor×c1/(c1+c2). ICP order allocating section 114 outputs information indicating the ICP order of the left channel to ICP analysis section 117 and multiplexing section 120.

Spectrum splitting section 115 splits the band for the frequency coefficients l(f) and r(f) of the left and right channel residual signals with reference to the split frequency FTH, and outputs the frequency coefficients l(f) and r(f) in the lower band part to lower band encoding section 119 and outputs the frequency coefficients $l_H(f)$ and $r_H(f)$ in the higher band part to ICP analysis section 117. Further, spectrum splitting section 115 quantizes a split flag indicating the number of MDCT coefficients to be encoded in low band coding section 11, and outputs the result to multiplexing section 120.

Spectrum splitting section 116 splits the band for the frequency coefficients m(f) of the monaural residual signal with reference to the split frequency FTH and outputs the frequency coefficients $m_H(f)$ in the higher band part to ICP analysis section 117.

ICP analysis section 117 is comprised of an adaptive filter, and performs an ICP analysis using the correlation relationship between the frequency coefficients $l_H(f)$ in the higher band part of the left channel residual signal and the frequency coefficients $m_H(f)$ in the higher band part of the monaural residual signal, and generates ICP parameters of the left channel residual signal. Similarly, ICP analysis section 117 performs an ICP analysis using the correlation relationship between the frequency coefficients $r_H(f)$ in the higher band part of the right channel residual signal and the frequency coefficients $m_H(f)$ in the higher band part of the monaural residual signal, and generates ICP parameters of the right channel residual signal. Here, the order of each ICP parameter is calculated in ICP order allocating section 114. ICP analysis section 117 outputs the ICP parameters to ICP parameter quantization section 118.

ICP parameter quantization section 118 quantizes the ICP parameters outputted from ICP analysis section 117 and outputs the results to multiplexing section 120. Here, it is also possible to adjust the number of bits used to quantize the ICP parameters in ICP parameter quantization section 118, based on the correlation between the monaural residual signal and the left and right channel residual signals. In this case, the number of ICP bits decreases when the correlation is higher. When the total number of bits is referred to as "BIT," the number of bits used to quantize the ICP parameters of the left channel residual signal can be calculated according to BIT×c2/(c1+c2). Similarly, the number of bits used to quantize the ICP parameters of the right channel residual signal can be calculated according to BIT×c1/(c1+c2).

Lower band encoding section 119 encodes the frequency coefficients $l_L(f)$ and $r_L(f)$ in the lower band parts of the left and right channel residual signals and outputs the resulting encoded data to multiplexing section 120.

Multiplexing section 120 multiplexes the encoded data of LP parameters outputted from LP analysis and quantization section 102, the encoded data of monaural signal outputted from monaural encoding section 104, the encoded data of pitch parameters outputted from pitch analysis and quantization section 105, the information indicating the ICP order of left channel residual signal outputted from ICP order allocating section 114, the quantized split flag outputted from spectrum splitting section 115, the quantized ICP parameters outputted from ICP parameter quantization section 118 and the encoded data of the frequency coefficients in the lower band part of left and right channel residual signals outputted from lower band encoding section 119, and outputs the resulting bit stream.

Figure 2:
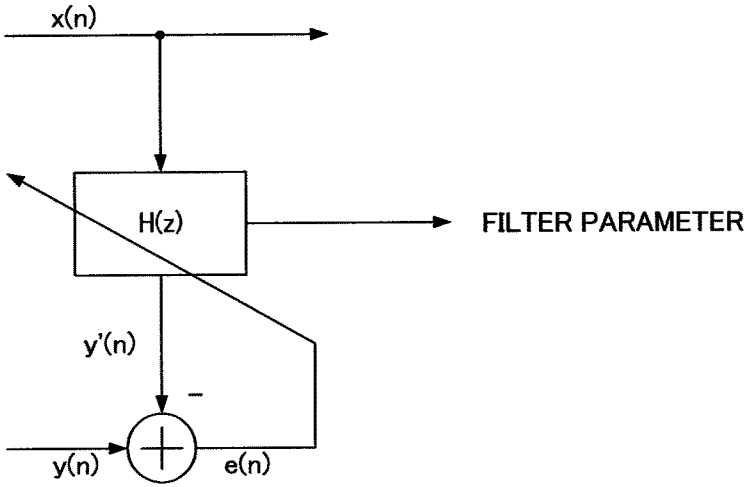
FIG. 2 is a block diagram showing the main components inside an ICP coding section according to Embodiment 1 of the present invention.

FIG. 2 illustrates the configuration and operations of an adaptive filter forming ICP analysis section 117. In this figure, H(z) holds H(z)=b0+b1(z−1)+b2(z−2)+ . . . +bk(z−k), and represents the model (i.e. transfer function) of an adaptive filter such as a FIR (Finite Impulse Response) filter. Here, k represents the order of filter coefficients, b=[b0, b1, . . . , bk] represents the adaptive filer coefficients, x(n) represents the input signal of the adaptive filter, y'(n) represents the output signal of the adaptive filter and y(n) represents the reference signal of the adaptive filter. In ICP analysis section 117, x(n) corresponds to $m_H(f)$, and y(n) corresponds to $l_H(f)$ or $r_H(f)$.

According to following equation 5, the adaptive filter finds and outputs adaptive filter parameters b=[b0, b1, . . . , bk] to minimize the mean square error ("MSE") between the prediction signal and the reference signal. Also, in equation 5, E represents the statistical expectation operator, E{.} represents the ensemble average operation, K represents the filter order and e(n) represents the prediction error.

(Equation 5)

$$\begin{aligned} MSE(b) &= E\{[e(n)]^2\} \\ &= E\{[y(n) - y'(n)]^2\} \\ &= E\left\{\left[y(n) - \sum_{i=0}^{K} b_i x(n-i)\right]^2\right\} \end{aligned} \quad [5]$$

Figure 3:
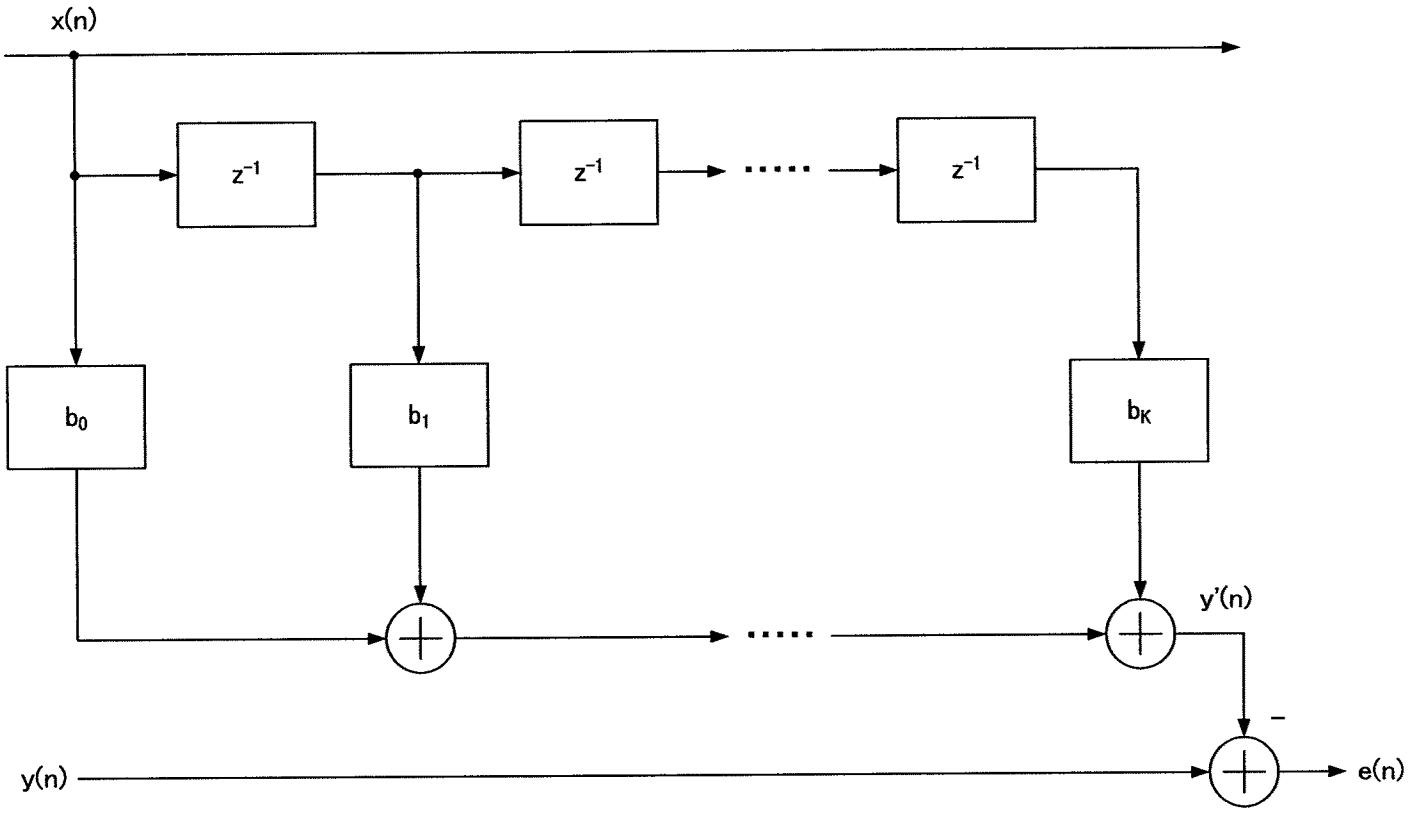
FIG. 3 is a diagram showing an example of an adaptive FIR filter used for ICP analysis and ICP synthesis.

Here, there are many different structures of H(z) in FIG. 2. FIG. 3 shows one of the structures. The filter structure shown in FIG. 3 is a conventional FIR filter.

Figure 4:
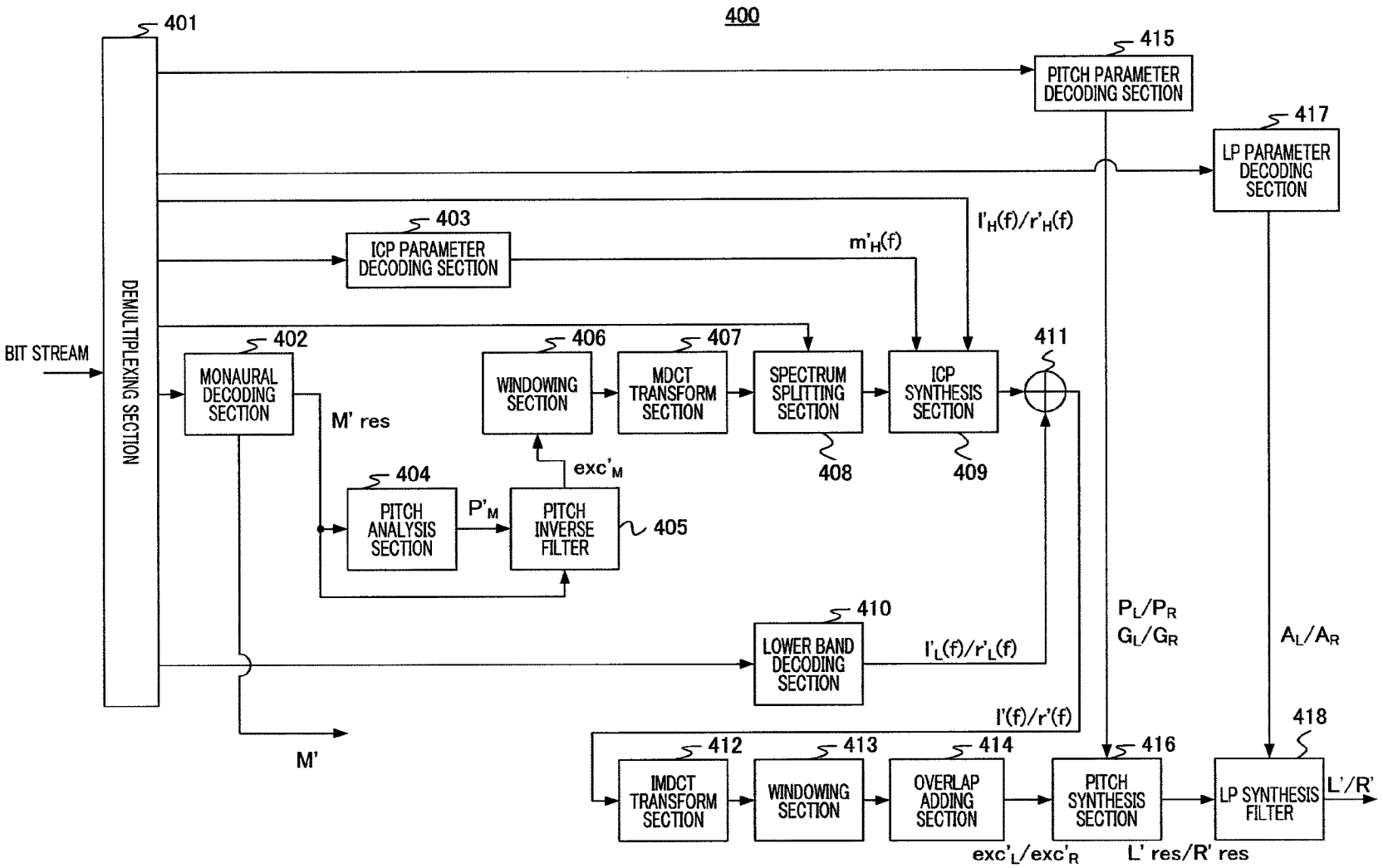
FIG. 4 is a block diagram showing the configuration of a decoding apparatus according to Embodiment 1 of the present invention.

FIG. 4 is a block diagram showing the configuration of the decoding apparatus according to the present embodiment. The bit stream transmitted from coding apparatus shown in FIG. 1 is received by decoding apparatus 400 shown in FIG. 4.

Demultiplexing section 401 demultiplexes the bit stream received by decoding apparatus 400, and outputs the encoded data of LP parameters to LP parameter decoding section 417, the encoded data of pitch parameters to pitch parameter decoding section 415, the quantized ICP parameters to ICP parameter decoding section 403, the encoded data of monaural signal to monaural decoding section 402, the information indicating the ICP order of left channel residual signal to ICP synthesis section 409, the quantized split flag to spectrum splitting section 408 and the frequency coefficients in the lower band part of the left and right channel residual signals to lower band decoding section 410.

Monaural decoding section 402 decodes the encoded data of monaural signal and acquires the monaural signal M' and the monaural residual signal M'res. Monaural decoding section 402 outputs the monaural residual signal M'res to pitch analysis section 404 and pitch inverse filter 405.

ICP parameter decoding section 403 decodes the quantized ICP parameters and outputs the resulting left and right channel ICP parameters to ICP synthesis section 409.

Pitch analysis section 404 performs a pitch analysis of the monaural residual signal M'res and outputs the pitch period $P'_M$ of the monaural residual signal to pitch inverse filter 405. Pitch inverse filter 405 performs pitch inverse filtering of the monaural residual signal M'res using the pitch period $P'_M$, and outputs the monaural residual signal $exc'_M$ not including the pitch period components to windowing section 406.

Windowing section 406 performs windowing processing of the monaural residual signal $exc'_M$ to MDCT transform section 407. Here, the window function in the windowing processing of windowing section 406 is given by above equation 2.

MDCT transform section 407 performs a MDCT transform of the monaural residual signal $exc'_M$ subjected to windowing processing and outputs the frequency coefficients m'(f) of the resulting monaural residual signal to spectrum splitting section 408. Here, the calculation of the MDCT transform in MDCT transform section 407 is given by above equation 3.

Spectrum splitting section 408 splits the whole band with reference to the split frequency FTH and then outputs the frequency coefficients $m'_H(f)$ in the higher band part of the monaural residual signal to ICP synthesis section 409.

ICP synthesis section 409 is comprised of an adaptive filter, and filters the frequency coefficients $m'_H(f)$ in the higher band part of the monaural residual signal using the left channel ICP parameters, thereby calculating the frequency coefficients $l'_H(f)$ in the higher band part of the left channel residual signal. Similarly, ICP synthesis section 409 filters the frequency coefficients $m'_H(f)$ in the higher band part of the monaural residual signal using the right channel ICP parameters, thereby calculating the frequency coefficients $r'_H(f)$ in the higher band part of the right channel residual signal. ICP synthesis section 409 outputs the frequency coefficients $l'_H(f)$ and $r'_H(f)$ in the higher band parts of the left and right channel residual signals to adding section 411.

Also, the frequency coefficients $l'_H(f)$ in the higher band part of the left channel residual signal can be calculated according to following equation 6. Here, in equation 6, $b_i^L$ represents the i-th element of reconstructed left channel ICP parameters, and K is acquired by the information indicating the left channel ICP order. Further, the frequency coefficients $r'_H(f)$ in the higher band part of the right channel residual signal can be calculated in the same way as above.

(Equation 6)

$$l'_H(f) = \sum_{i=0}^{K} b_i^L m'_H(f-i) \quad [6]$$

Lower band decoding section 410 decodes the encoded data of frequency coefficients in the lower band part of the left and right channel residual signals, and outputs the resulting frequency coefficients kV) and $r_L'(f)$ in the lower band part of the left and right channel residual signals to adding section 411.

Adding section 411 combines the frequency coefficients $l_L'(f)$ and $r_L'(f)$ in the lower band part of the left and right channel residual signals and the frequency coefficients $l'_H(f)$ and $r'_H(f)$ in the higher band part of the left and right channel residual signals, and outputs the resulting frequency coefficients l'(f) and r'(f) of the left and right channel residual signals to IMDCT transform section 412.

IMDCT transform section 412 performs an IMDCT transform of the frequency coefficients l'(f) and r'(f) of the left and right channel residual signals. The calculation in the IMDCT transform of the frequency coefficients l'(f) of the left channel residual signal is performed according to following equation 7. Here, in equation 7, s(k) represents IMDCT coefficients including time domain aliasing. Also, the calculation in the IMDCT transform of the frequency coefficients r'(f) of the right channel residual signal is performed in the same way.

(Equation 7)

$$s(k) = \frac{2}{N}\sum_{f=0}^{N-1} l'(f)\cos\left[\pi\frac{(k+N/2+0.5)(f+0.5)}{N}\right] \quad [7]$$

$$k = 0, \ldots 2N-1$$

To reconstruct the left and right channel residual signals, windowing section 413 performs windowing processing of the output signals of IMDCT transform section 412, and overlap adding section 414 overlaps and adds the output signals of windowing section 413, thereby producing the left and right channel residual signals $exc'_L$ and $exc'_R$. The reconstructed left and right channel residual signals $exc'_L$ and $exc'_R$ are outputted to pitch synthesis section 416.

Pitch parameter decoding section 415 decodes the encoded data of pitch parameters and outputs the resulting pitch parameters (i.e. pitch periods $P_L$ and $P_R$ and pitch gains $G_L$ and $G_R$) of the left and right channel residual signals to pitch synthesis section 416.

Pitch synthesis section 416 performs pitch synthesis filtering of the left and right channel residual signals $exc'_L$ and $exc'_R$ using the pitch periods $P_L$ and $P_R$ and pitch gains $G_L$ and $G_R$, and outputs the resulting left and right channel residual signals L'res and R'res to LP synthesis filter 418.

LP parameter decoding section 417 decodes the encoded data of LP parameters and outputs the resulting LP coefficients $A_L$ and $A_R$ to LP synthesis filter 418.

LP synthesis filter 418 performs LP synthesis filtering of the left and right channel residual signals L'res and R'res using the LP coefficients $A_L$ and $A_R$, and produces the left channel signal L' and right channel signal R'.

Thus, decoding apparatus 400 of FIG. 4 performs decoding processing of signals received from coding apparatus 100 of FIG. 1, thereby producing both the monaural signal M' and stereo speech signals L' and R'.

As described above, according to the present embodiment, by applying a coding method of high quantization precision to the lower band part of relatively high perceptual importance level and applying an efficient coding method with ICP to the higher band part of relatively low perceptual importance level, it is possible to realize both improved efficiency of coding/decoding and improved quality of decoded speech.

Also, according to the present embodiment, by applying monaural signals decoded in the MDCT domain by the MDCT transform encoder to ICP process, ICP is directly performed in the MDCT domain, so that additional algorithmic delay is not caused.

OTHER EMBODIMENT

In Embodiment 1, the present invention is still usable if blocks 105, 106, 107 and 108 in FIG. 1 and blocks 404, 405, 415 and 416 in FIG. 4, which are related to pitch analysis and pitch filtering, are eliminated.

Also, in Embodiment 1, it is possible to replace an adaptive frequency splitter used in spectrum splitting sections 115 and 116 with a frequency splitter of the fixed split frequency. In this case, the split frequency is arbitrarily set to, for example, 1 kHz.

Also, in Embodiment 1, the calculation of the adaptive ICP order in ICP order allocating section 114 and the adaptive bit allocation of ICP parameters in ICP parameter quantization section 118 can be changed to the fixed ICP order and fixed bit allocation, respectively.

Also, in Embodiment 1, when the monaural encoder is a transform encoder such as a MDCT transform coder, it is possible to directly acquire a decoded monaural signal (or decoded monaural residual signal) in the MDCT domain from the monaural encoder on the encoder side and from the monaural decoder on the decoder side. That is, in Embodiment 1, by eliminating blocks 107, 108, 110 and 112 in FIG. 1 on the encoder side, it is possible to directly acquire frequency coefficients of decoded monaural residual signal from monaural encoding section 104 instead of the frequency coefficients m(f) of monaural residual signal outputted from MDCT transform section 112. Also, by eliminating blocks 404, 405, 406 and 407 in FIG. 4 on the decoder side, it is possible to directly acquire frequency coefficients of decoded monaural residual signal from monaural decoding section 402 instead of the frequency coefficients m'(f) of monaural residual signal outputted from MDCT transform section 407.

Also, as described above, the present invention is applicable to speech signals of the PCM format. Further, even if LP filtering and pitch filtering are eliminated, the present invention is still usable. In this case, windowed monaural and left and channel speech signals are converted to MDCT domain signals. The higher band part of MDCT coefficients are encoded with ICP. The lower band part is encoded by a high precision encoder. On the decoder side, the transmitted lower band part and the higher band part reconstructed by ICP synthesis are combined to reconstruct the MDCT coefficients of left and right speech signals. After that, by means of IMDCT, windowing and overlap adding, it is possible to acquire synthesized speech signals.

Also, the coding scheme explained in above Embodiment 1 uses a monaural residual signal to reconstruct left and right channel residual signals, and therefore can be referred to as the "M-LR coding scheme." The present invention can employ another coding scheme called "M-S coding scheme." With this alternative scheme, it is possible to reconstruct a side residual signal using a monaural residual signal. In this case, the configuration on the encoder side is substantially the same as FIG. 1, which is the block diagram on the encoder side of M-LR coding scheme in Embodiment 1, processing in blocks 102, 103, 105, 106, 109, 111, 115 and 119 for right and left channel signals are replaced with processing for side channel signals. Also, the side speech signal S(n) is calculated according to following equation 8 in monaural signal synthesis section 101. Here, in equation 8, n represents the time index of a frame with a length of N. Also, although the configuration on the decoder side is substantially the same as in FIG. 4, processing for right and left channel signals in blocks 409, 410, 411, 412, 413, 415, 416, 417 and 418 are replaced with processing for side channel signals.

(Equation 8)

$$S(n) = \frac{1}{2}[L(n) - R(n)] \quad [8]$$

Moreover, at the decoder, the synthesized left and right channel speech signals (L' and R') can be calculated by using the reconstructed side signal S' and monaural signal M', according to following equation 9.

[9]

$$L'(n)=S'(n)+M'(n) \text{ and } R'(n)=S'(n)-M'(n) \quad \text{(Equation 9)}$$

Also, the present invention can apply one common ICP process for the frequency coefficients acquired by MDCT calculation in the whole band. In this case, ICP prediction error signals (especially prediction error signals in the lower frequency band) have to be encoded and transmitted.

In the present invention, after the MDCT calculation, it is possible to divide the frequency coefficients into k (k>2) sub-bands and perform an ICP analysis on a per sub-band basis. Here, the number of ICP parameters (i.e. ICP order) may vary between sub-bands. This number depends on the correlation value or the positions of sub-bands. Generally, a sub-band of higher frequency has a smaller number of ICP parameters. Alternatively, the present invention may adaptively control the bit allocation for each sub-band.

Also, above Embodiment 1 performs the ICP calculation according to above equation 5 and use the filter structure shown in FIG. 3. Alternatively, the present invention can change the one-side ICP into two-side ICP and replace the calculation of the prediction signal y'(n) in equation 5 with following equation 10. In this case, the ICP order becomes N1+N2 (where N1 and N2 are positive constants).

(Equation 10)

$$y'(n) = \sum_{i=-N1}^{N2} b_i x(n-i) \quad [10]$$

Also, although a case has been described with the present embodiment where a frequency-domain transform is performed using a MDCT transform, the present invention is not limited to this, and it is equally possible to perform a frequency-domain transform using another frequency-domain transform scheme such as a FFT (Fast Fourier Transform) instead of the MDCT transform.

Also, the present invention can apply error weighting to ICP calculation used in ICP analysis section 117 to incorporate psychoacoustic consideration. This can be realized by minimizing E[e2(f)×w(f)] instead of E[e2(f)] in above equation 5. Here, w(f) is weighting coefficients derived from an psychoacoustic model. The weighting coefficients are used to adjust the prediction errors by multiplying low weights by a high energy frequency (or band) and multiplying high weights by a low energy frequency (or band). For example, w(f) can be inversely proportional to the energy of $m_H(f)$. Therefore, one possible format of w(f) is the following equation (where α and β are tuning parameters).

(Equation 11)

$$w(f) = \frac{1}{\alpha \times |m_H(f)|^2 + \beta} \quad [11]$$

Also, although an example case has been described above where the decoding apparatus according to the above-described embodiments receives and processes a bit stream transmitted from the coding apparatus according to the above-described embodiments, the present invention is not limited to this, and the essential requirement is that a bit stream received and processed in the decoding apparatus according to the above-described embodiments is transmitted from a coding apparatus that can generate a bit stream that can be processed in the decoding apparatus.

Also, the above explanation is exemplification of preferred embodiments of the present invention, and the scope of the present invention is not limited to this. The present invention is applicable in any cases as long as the system includes a coding apparatus and decoding apparatus.

Also, the speech coding apparatus and decoding apparatus according to the present invention can be mounted on a communication terminal apparatus and base station apparatus in mobile communication systems, so that it is possible to provide a communication terminal apparatus, base station apparatus and mobile communication systems having the same operational effect as above.

Although a case has been described with the above embodiments as an example where the present invention is implemented with hardware, the present invention can be implemented with software. For example, by describing the algorithm according to the present invention in a programming language, storing this program in a memory and making the information processing section execute this program, it is possible to implement the same function as the speech coding apparatus of the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2007-092751, filed on Mar. 30, 2007, including the specification, drawings and abstract, is incorporated herein by reference in its entirety.

INDUSTRIAL APPLICABILITY

The speech coding apparatus and speech coding method of the present invention are suitable to mobile telephones, IP telephones, television conference, and so on.

The invention claimed is:

1. A coding apparatus, comprising:

a residual signal acquirer that comprises an integrated circuit and acquires a first channel residual signal and a second channel residual signal that are linear prediction residual signals for a first channel signal and a second channel signal of a stereo signal;

a frequency domain transformer that transforms the first channel residual signal and the second channel residual signal into a frequency domain and acquires a first channel frequency coefficient and a second channel frequency coefficient;

a first encoder that encodes the first channel frequency coefficient and the second channel frequency coefficient in a band lower than a threshold frequency;

a second frequency domain transformer that transforms a linear prediction residual signal for a monaural signal generated from the stereo signal into a frequency domain, and acquires a monaural frequency coefficient; and a second encoder that encodes the first channel frequency coefficient and the second channel frequency coefficient in a band equal to or higher than the threshold frequency, using a coding method with a lower encoding precision than an encoding method used in the encoding by the first encoder, wherein the second encoder comprises a threshold frequency setter that sets a threshold frequency based on a first correlation value between the first channel frequency coefficient and the monaural frequency coefficient and a second correlation value between the second channel frequency coefficient and the monaural frequency coefficient; and a correlation calculator determining the threshold frequency according to the following:

$$F_{TH} = \left(1k + \frac{F_S}{32} \times \frac{c_2}{c_1 + c_2}\right),$$

wherein the threshold frequency ($F_{TH}$) decreases as correlation values c1 or c2 increases, a frequency band is divided into a lower band part and an upper band part, the lower band part having a frequency band lower than the threshold frequency, and the upper band part having a frequency band equal to or higher than the threshold frequency where $F_S$ is a sampling frequency, 1k is a constant, c1 is a correlation value between the frequency coefficient of the first channel residual signal and the frequency coefficient of the monaural residual signal, and c2 is a correlation value between the frequency coefficient of the second channel residual signal and the frequency coefficient of the monaural residual signal.

2. A coding method, comprising:

acquiring a first channel residual signal and a second channel residual signal that are linear prediction residual signals for a first channel signal and a second channel signal of a stereo signal;

transforming the first channel residual signal and the second channel residual signal into a frequency domain and acquiring a first channel frequency coefficient and a second channel frequency coefficient;

encoding the first channel frequency coefficient and the second channel frequency coefficient in a band lower than a threshold frequency;

transforming a linear prediction residual signal for a monaural signal generated from the stereo signal into a frequency domain, and acquiring a monaural frequency coefficient;

encoding the first channel frequency coefficient and the second channel frequency coefficient in a band equal to or higher than the threshold frequency, using a coding method with a lower encoding precision than the encoding method used for the encoding of the first channel frequency coefficient and the second channel frequency coefficient in the band lower than the threshold frequency; and determining the threshold frequency according to the following:

$$F_{TH} = \left(1k + \frac{Fs}{32} \times \frac{c_2}{c_1 + c_2}\right),$$

wherein the threshold frequency ($F_{TH}$) decreases as correlation values c1 or c2 increases, a frequency band is divided into a lower band part and an upper band part, the lower band part having a frequency band lower than the threshold frequency, and the upper band part having a frequency band equal to or higher than the threshold frequency where $F_S$ is a sampling frequency, 1k is a constant, c1 is a correlation value between the frequency coefficient of the first channel residual signal and the frequency coefficient of the monaural residual signal, and c2 is a correlation value between the frequency coefficient of the second channel residual signal and the frequency coefficient of the monaural residual signal.

* * * * *